United States Patent [19]

Broussard

[11] 4,144,806

[45] Mar. 20, 1979

[54] TRASH COMPACTOR FOR INDUSTRIAL USE

[76] Inventor: Vernon K. Broussard, P.O. Box 558, St. Martinville, La. 70582

[21] Appl. No.: 870,969

[22] Filed: Jan. 20, 1978

[51] Int. Cl.[2] ..... B30B 15/04

[52] U.S. Cl. ..... 100/100; 100/215; 100/218; 100/229 A; 100/255; 414/423

[58] Field of Search ..... 100/100, 229 A, 218, 100/215, 255; 214/315, 316, 501

[56] References Cited

U.S. PATENT DOCUMENTS

| | | | |
|---|---|---|---|
| 716,422 | 12/1902 | Hulscher | 100/255 |
| 3,318,231 | 5/1967 | Felts | 100/229 A |
| 3,511,176 | 5/1970 | Szaj | 100/229 A |
| 3,575,103 | 4/1971 | Charles | 100/229 A |
| 3,606,830 | 9/1971 | Chaney | 100/229 A |
| 3,610,139 | 10/1971 | Bowles | 100/229 A |
| 3,687,064 | 8/1972 | Glanz | 100/100 |
| 3,695,175 | 10/1972 | Bausenbach | 100/229 A |
| 3,768,399 | 10/1973 | Martiniak | 100/229 A |
| 3,799,374 | 3/1974 | Weaver | 100/229 A |
| 3,848,797 | 11/1974 | Kolling | 100/229 A |

*Primary Examiner*—Billy J. Wilhite
*Attorney, Agent, or Firm*—James B. Lake, Jr.

[57] ABSTRACT

A horizontal piston-type compactor is mounted in a housing, having an open end, that is diagonally joinable to a trash container, also having an open end, the open ends coinciding in horizontal alignment to form the unit. A trash receiving port, surrounded by a combing, is defined in the top of the housing and overhangs the bottom of the trash container owing to diagonal joint between the housing and the container, to provide an interior spillage area and use of higher trash compacting pressure in the container. Side liners are pivoted to the respective sides of the container adjacent its open end and extend oppositely therefrom short of an opposite closed end thereof. Angular camming levers are respectively pivoted through the sides of the container adjacent the closed end and are manually operable for camming the side liners inward when the container is joined to the housing, and releasing the liners when the separated container is dumped thereby reducing compacting pressure of the trash therein to facilitate the gravitational emptying of the container. The housing is fixed to an end of a skid that extends to provide a base for the slidable mounting of the container. A lid, with a gravitationally operable latch that locks it open and closed, is pivotally mounted on the combing of the trash receiving port.

4 Claims, 4 Drawing Figures

TRASH COMPACTOR FOR INDUSTRIAL USE

BACKGROUND OF THE INVENTION

The invention relates generally to trash compactors, and more particularly to compactors of the horizontal piston type for industrial use.

There is plentiful prior art of the type of the invention, such as U.S. Pat. Nos. 3,318,231, 3,511,176, 3,575,103, 3,606,830, 3,610,139, 3,687,064, 3,695,175, and 3,799,374, with varying characteristics such as roll-on/roll-off truck type bodies, a remote power unit for a plurality of compactors, retaining flappers for trash container, low fluid pressure and regulating compactors having a plurality of sub-compacting compartments, automatic control of packer ram, fluid operated doors between compactor and trash container, a wheeled power compacting unit for moving to a trash container, dual trash compactors, and truck loaded trash container with stationary compactor. In all cases where there are separate trash and compacting units, they are joined along vertical lines, respectively, and where provisions are made for trash containers, they are restricted to retaining the compacted trash therein.

SUMMARY OF THE INVENTION

It is an object of the invention to provide a compacting unit having only two ports, and a trash container unit having only one port.

Another object of the invention is to provide a trash container unit in which compacted pressure therein is reduced prior to dumping for easy emptying of the trash.

Another object of the invention is to provide a gravitationally operable latch for locking a receiving port lid open and closed.

DESCRIPTION OF THE PREFERRED EMBODIMENTS

Figure 1:
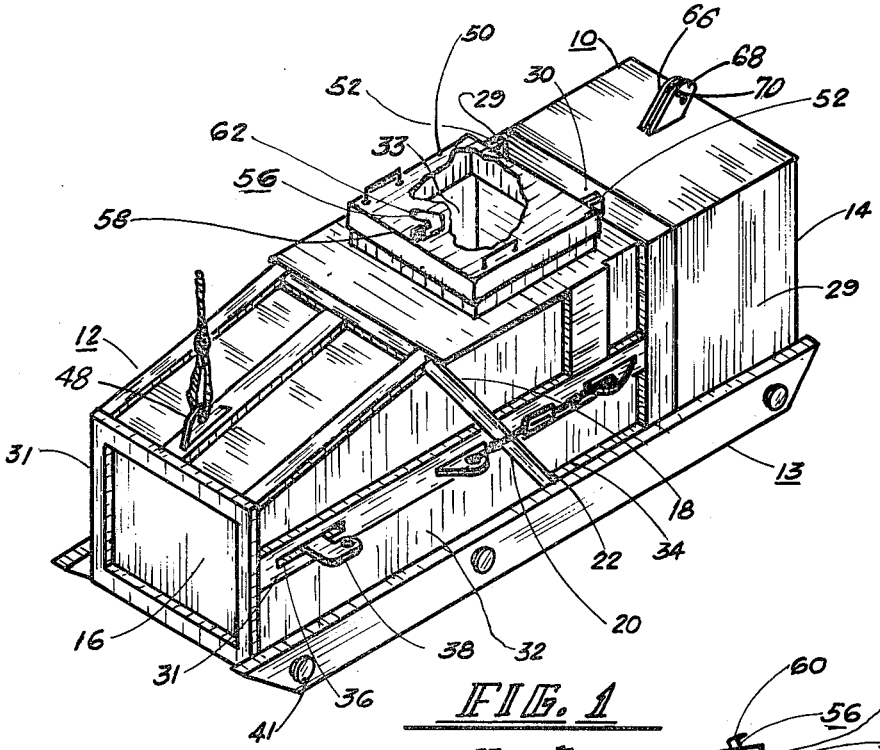
FIG. 1 is a three dimensional view from the upper left of the invention with receiving port lid partially broken away and locked closed.

Referring to FIGS. 1–4, the invention comprises housing means unit 10 having an hydraulically operable piston 11 that is mounted for operation along the center horizontal axis of unit 10, and a trash container unit 12 that is joinable contiguously to unit 10 and in coincidence with the center horizontal axis thereof. Unit 10 is fixed to, and unit 12 is slidable on a skid 13.

Both units 10 and 12 are hollow truncated prisms having square closed ends 14 and 16 respectively and truncated open ends 18 and 20 respectively, said open ends being complementary to each other and cooperating to form a diagonal joint 22 therebetween. The units are held tightly together by means of stays 24 and turnbuckles 26 engaging in pad eyes 27–28 respectively mounted on opposite sides 29 and 31 of units 10 and 12. The diagonal joint 22 thus defines a unit 10 top 30 that overhangs a unit 12 bottom 32. A trash receiving port 33 defined in top 30 is thus directly above an overhung part 34 of bottom 32 to eliminate any necessity for a similar port in unit 12 and additionally provides a trash spillage area. The arrangement permits higher hydraulic and piston pressures for greater trash compaction in unit 12, and less spillage of trash when unit 12 is separated from unit 10 for dumping.

Horizontal parallel slits 36 are defined in opposing sides 31 of unit 12 adjacent the closed end 16 thereof and in which are respectively pivoted angular camming levers 38, having interior camming portions 40 and exterior manually operable portions 42 in which are defined "eyes" 43. Also side liners 44 are interiorly pivoted by ends to the respective sides 31 of unit 12 adjacent its truncated open end 20, and with opposite free ends 46 extending beyond said slits 36 for engagement by respective camming portions 40. And a pad "eye" 48 is mounted on the top of unit 12 above slits 36 to aid in the positioning thereof as needed.

A lid 50 is pivoted by hinges 52 to a combing 54 surrounding trash receiving port 33 for the opening and closing thereof. A latch 56 is horizontally pivoted by pivot 57 to the top of lid 50 adjacent diagonal joint 22 and a front edge 58 for the locking open and closed of said lid by means of the force of gravity. Latch 56 comprises a pair of hooks 60 and 62 horizontally offset to a side of pivot 57 with both opening toward it, and vertically offset above and below said pivot and with the mass of said latch adapted to swing it clockwise around said pivot. A catch 64 is interiorly mounted in the forward part of said combing 54 and adapted to be engaged by hook 60. A catch 66 is fixed to the top 30 adjacent the closed end of unit 10 and comprises a pair of plates 68 spaced horizontally apart by a rod 70 that is adapted to be engaged by hook 62. Said hooks are respectively pivoted into engagement with respective catches by gravity when the lid is closed and opened.

Figure 2:
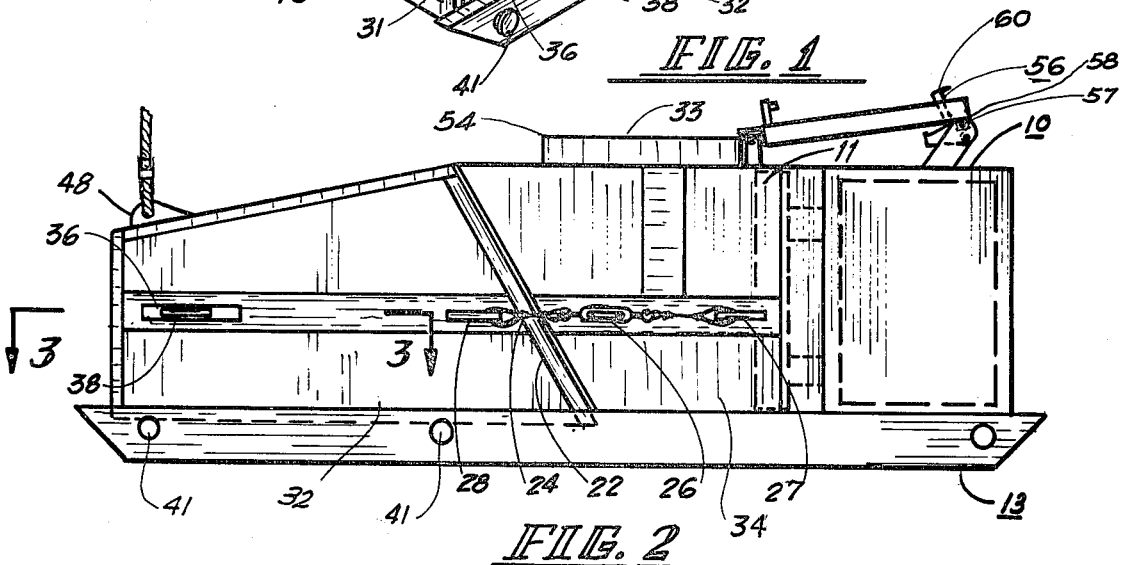
FIG. 2 is a side elevational view of the invention with receiving port lid locked open.
Figure 4:
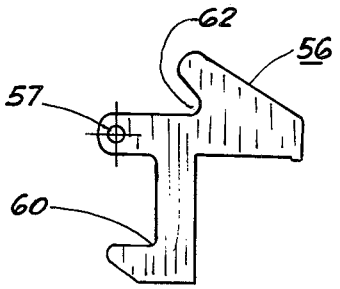
FIG. 4 is a side elevation, enlarged, of the receiving port lid latch.
Figure 3:
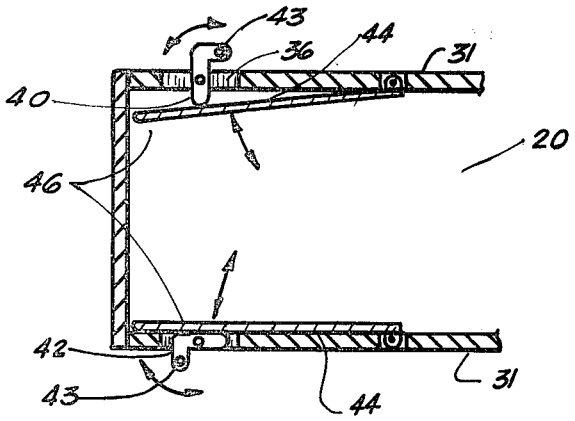
FIG. 3 is a sectional view taken along lines 3—3 of FIG. 2 showing camming levers and side liners.

In operation with the trash compactor assembled as shown in FIG. 2 and with both side liners cammed inwardly by camming levers 38 being positioned as shown in the upper part of FIG. 3, trash is dumped into the open receiving port 33 and pushed toward the closed end 16 of unit 12 by hydraulically powered piston 11. When unit 12 is full of trash compacted by said piston 11, turnbuckles 26 are loosened and with stays 24 disengaged from pad "eyes" 28. Unit 12 is slid on transverse rods 41 of skid 13 and lifted out of connection with unit 10 along diagonal joint 22 by hoist lines engaged in pad "eyes" 28 and lowered on a dump vehicle (not shown). Said hoist lines are disengaged from pad "eyes" 28 and engaged with camming levers 38 to upend unit 12 and pivot levers 38 as shown in the lower part of FIG. 3 when the hoist lines are taken in, thereby releasing side liners 44 to pivot outwardly by pressure of the compacted trash to release said compaction and induce a free fall of the trash from the open end of unit 12.

When the trash compactor is not being loaded, lid 50 is swung closed to lock shut and prevent escape of deposited but uncompacted trash.

What is claimed is:

1. A trash compactor having a piston type compactor and comprising in combination:

(a) a housing means and a trash container means, a skid base means for mounting said housing and container means in horizontal alignment and cooperation, and for limited mobility of the whole;

(b) said housing means being fixed to an end of said skid base means and having a truncated open end and a closed opposite end for housing said piston type compactor therein, and having a longer top side than bottom side in which a trash receiving port is defined adjacent said open end; and (c) said trash container means slidably mounted on said skid base means and having an only opening, a truncated end, complementary to the open end of said housing means for horizontally joining therewith in a diagonal joint wherein said trash receiving port of said housing means overhangs a bottom portion of said trash container means, thereby maximizing strength and volume, and minimizing weight, and providing a trash spillage area of and in said trash container means.

2. A trash compactor as described in claim 1 wherein said trash container means comprises:

(a) side liner means interiorly pivoted by ends to opposite vertical sides of said container means and adjacent said truncated open end, and with liner means free ends opposite said pivoted ends extending short of said container means closed end, said liners being free to pivot inward from parallel to said opposite vertical sides in which slits are defined adjacent said closed opposite end;

(b) angular camming levers pivotally mounted in said slits for camming the free ends of said liner means inward before compacting deposited trash, and for disengaging from said liner means when said trash container means is suspended open side down for dumping, whereby the restricted volume thereof in compacting is enlarged and compaction reduced for easy emptying.

3. A trash compactor as described in claim 1 wherein said housing means comprises: p1 (a) lid means hinged by a rear edge thereof to said housing means and adapted to swing to open and close said trash receiving port for the deposit and retention of uncompacted trash;

(b) automatic latch means pivotally mounted on said lid means adjacent an opposite edge from said hinged rear edge, and fixed to said housing means for locking said lid means in open and closed positions.

4. Housing means as described in claim 3 wherein said automatic latch means comprises:

(a) a latch pivoted to the front edge of said lid means to swing in a vertical plane, and defining a pair of hooks opening toward said front edge and horizontally offset from each other and said pivoted edge toward said hinged rear edge of said lid means, and vertically offset from each other and oppositely from said pivoted edge, said latch being shaped for its mass by the force of gravity to turn clockwise around its pivot when said lid means is in open and closed positions with the receiving port;

(b) two catches, one catch being an inwardly projecting flange fixed interiorly to a front edge of said receiving port and adapted to being pivotally engaged by said one hook, and the second catch being a horizontal rod supported by spaced uprights fixed to said housing means' top in rear of said receiving port and adapted to be engaged by the other of said hooks in swinging toward the front edge of said lid means.

* * * * *